United States Patent [19]

Gwathney et al.

[11] 4,391,188

[45] Jul. 5, 1983

[54] PIN-OFF AND DOOR CLOSURE ASSEMBLY FOR A STATIONARY REFUSE COMPACTOR

[75] Inventors: Kenneth W. Gwathney, Vernon; David L. Gann, Guin; Steven G. Seagraves, Sr., Millport, all of Ala.; Gary R. Fenner, Greenville; Gordon H. Fenner, Columbus, both of Miss.

[73] Assignee: Marathon Equipment Company, Vernon, Ala.

[21] Appl. No.: 231,021

[22] Filed: Feb. 3, 1981

[51] Int. Cl.[3] ..... B30B 15/06

[52] U.S. Cl. ..... 100/229 A; 100/295; 296/50; 220/1 T; 220/333

[58] Field of Search ..... 100/229 A, 295; 296/50; 220/1 T, 333

[56] References Cited

U.S. PATENT DOCUMENTS

| | | | |
|---|---|---|---|
| 3,229,618 | 1/1966 | O'Connor | 100/229 A |
| 3,250,414 | 5/1966 | Pioch | 105/229 A |
| 3,511,176 | 5/1970 | Szaj | 100/229 A |
| 3,575,103 | 4/1971 | Charles | 100/229 A |
| 3,583,313 | 6/1971 | Chaney | 100/229 A |
| 3,799,374 | 3/1974 | Weaver | 100/229 A |

FOREIGN PATENT DOCUMENTS

| | | | |
|---|---|---|---|
| 595837 | 4/1960 | Canada | 296/50 |
| 985462 | 3/1965 | United Kingdom | 100/229 A |

*Primary Examiner*—Billy J. Wilhite

*Attorney, Agent, or Firm*—Shlesinger, Arkwright, Garvey & Dinsmore

[57] ABSTRACT

A pin-off and door closure assembly for a stationary refuse compactor which includes a packer unit having a ram for forcing refuse into a portable container through a load opening in the door thereof, the container being removably attached to the packer unit. The pin-off portion of the assembly includes an elongated pipe which, when not in use, is stored in a refuse-free compartment on the face of the ram. The pin-off pipe is transferred to its position of use across the container door load opening by extension of the ram into the container, following which pins are inserted through both sides of the container into the ends of the pipe for securing the latter into position. A hinged flap forming the forward side of the storage compartment permits the pipe to be removed from the compartment upon retraction of the ram. A flexible cover stored on a container door above the load opening is swung outwardly and downwardly over the opening to prevent refuse from falling therethrough, following which the portable container is transported to a disposal site.

20 Claims, 12 Drawing Figures

25
38
46
43
116
120
124
134
11
11
118
39
122
45
132
66
130
94
126
48
156
158
118
159
160
40
128
150
144
136
148
146
140
120

PIN-OFF AND DOOR CLOSURE ASSEMBLY FOR A STATIONARY REFUSE COMPACTOR

BACKGROUND OF THE INVENTION

This invention relates to large stationary refuse compactors of the type including a portable refuse container which is detachably engaged with a packer unit having a ram for forcing refuse to a load opening in the door of the refuse container. The ram is repeatedly extended and retracted to compact the refuse within the container until it is filled. The portable refuse container is then detached from the packer unit and transported to a refuse disposal site.

In order to prevent the compacted refuse from dropping out of the container through the load opening during transport, it has been standard practice to place an elongated bar across the opening to restrain the compacted refuse, and to place a cover over the opening to prevent any refuse from falling out of the container through the opening. An example of such an arrangement is disclosed in U.S. Pat. No. 3,250,414, granted to Robert J. Pioch, on May 10, 1966.

The manual placement of the restraining member across the load opening is a difficult procedure since the restraining member must be very long to span the opening, and very strong, in order to withstand the forces exerted by the compacted refuse thereon. In actual practice, a steel pipe of approximately 8 feet long and 2 or more inches in diameter has been used, and the installation of the pipe requires that the ends thereof be engaged with supporting means on the container. The installation of such a pipe furthermore requires considerable room laterally of the compactor.

Attempts have been made to facilitate the engagement of the restraining member with the refuse container across the load opening, such as disclosed in U.S. Pat. No. 3,583,313, granted to Donal W. Chaney, on June 8, 1971. In this arrangement, however, it is still necessary to manually insert the restraining member through a side of the container and the packer unit.

In addition to the above noted installation problems, the openings in the container and packer unit also create a safety hazard which, in the past, have resulted in serious injury to individuals caused by inserting limbs through these openings. As a consequence, the compactor industry has abandoned the use of pin-off devices, and has been left with no means for restraining the compacted refuse in the container during transport.

SUMMARY OF THE INVENTION

The present invention is a pin-off and door closure assembly for a stationary refuse compactor of the type comprising a packer unit having a ram for forcing refuse into a portable container which affords simple and effective means for directly transferring a pin-off pipe from the packer unit to a position across the load opening of a refuse container, while at the same time eliminating the use of hazardous openings in the container or packer unit.

The present compactor includes a pin-off pipe which, when refuse is being directed by the packer unit ram into the refuse container, is stored in a refuse-free storage compartment on the face of the ram.

The present assembly further includes an assembly of the character described which, when the refuse container has been filled, the packer ram is extended into engagement with the container, following which pins are inserted through the container into the ends of the pin-off pipe preparatory to transporting the container to a disposal site. The storage compartment on the front face of the ram includes a front flap member which is hingedly engaged with the ram face so that, when the ram is retracted, the hinged flap is operative to allow the pin-off pipe to pass under the flap and remain positioned in engagement with the container. The storage compartment and pipe are co-extensive with the load opening in the container so that the pins may be readily inserted and removed from engagement with the container as desired, to install or remove the pin-off pipe.

The pin-off pipe of the present assembly rides completely within the storage compartment of the ram during the container filling operation, thereby requiring no opening in the side of the packer unit since the pin-off pipe is directly transferred into engagement with the container without removal thereof from the storage compartment and reinsertion through a side of the container.

The door closure of the present assembly includes a flexible cover secured within a rigid frame which is hinged at its mid-point to permit the storage of the closure in an area above the load opening of the container door. The frame is hingedly engaged with the door in such a manner that outward movement thereof with respect to the door may be effected to permit outward and downward movement of the cover with respect to the door opening to facilitate covering of any refuse protruding through the opening beyond the plane of the door. The lower half of the cover hinges within the upper half in order to reduce the overall size thereof in order to be stored within that portion of the frame of the door above the door opening.

DETAILED DESCRIPTION OF THE INVENTION

Referring now in greater detail to the drawings, the stationary compactor embodying the present invention is of generally conventional construction including a packer unit 20 which is adapted to be detachably engaged with a refuse container 22 by suitable and conventional attachment means 24.

Figure 1:
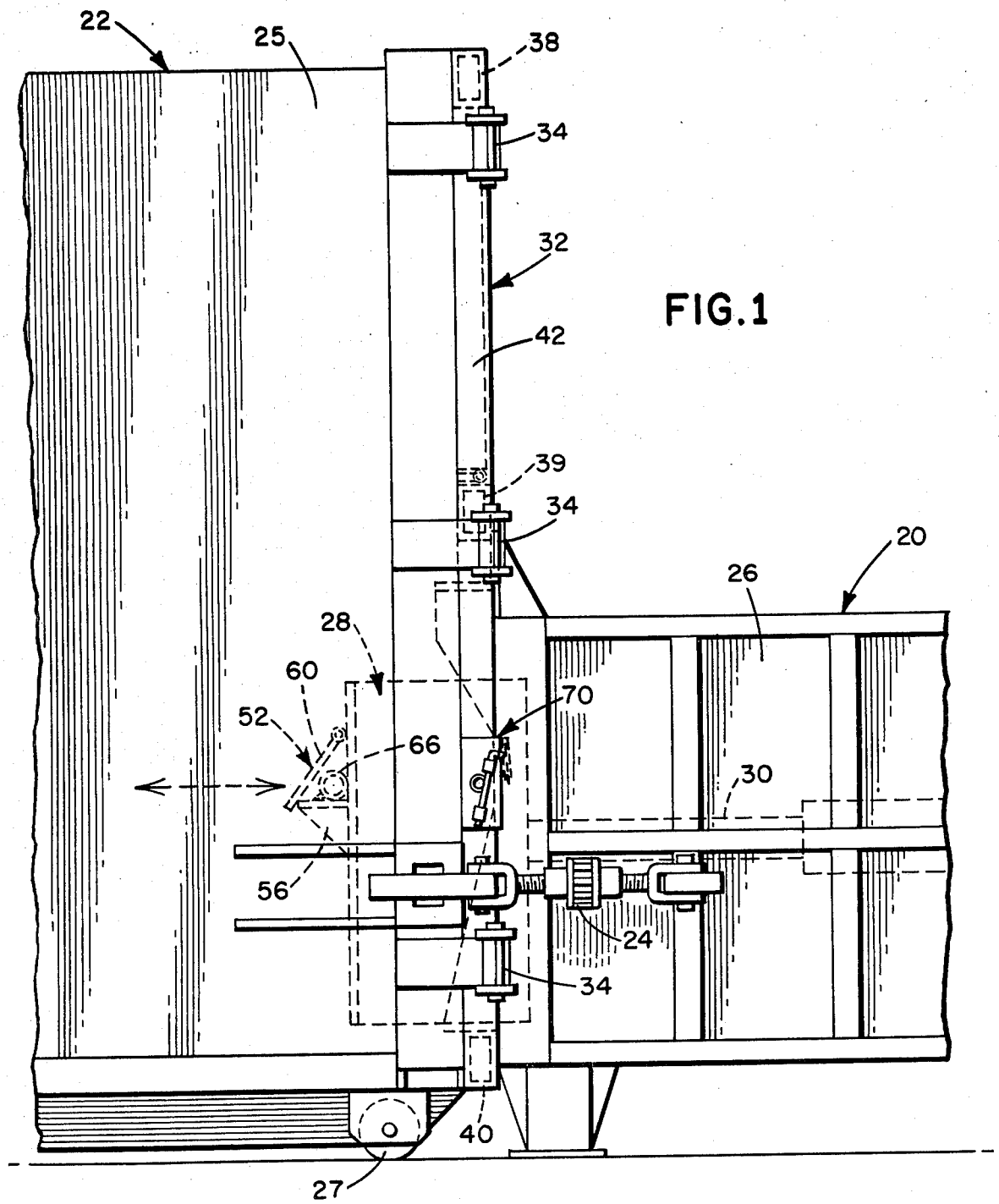
FIG. 1 is a fragmentary side elevational view of a stationary refuse compactor embodying the pin-off and door closure assembly of the present invention.
Figure 11:
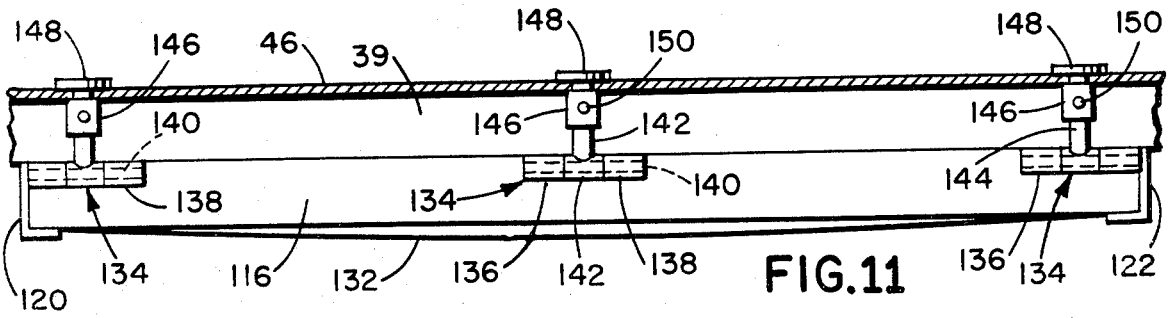
FIG. 11 is a sectional view taking along the lines 11—11 of FIG. 9, looking in the direction of the arrows.

Packer unit 20 includes an elongated housing 26 into which refuse is dumped and advanced forwardly by a ram 28 at one end of a piston 30 which reciprocates back and forth in housing 26 to force refuse in advance of the ram into container 22, as illustrated to advantage in FIG. 1.

Refuse container 22 includes a box-like housing 25 which is mounted on wheels or the like 27 for facilitating movement of the container away from the packer unit when the container is full. The end of housing 22 nearest to packer unit 20 is provided with a door 32 which is hingedly engaged at 34 with one side of the housing, the opposite side of the door being latched to the housing at 36. Door 32 includes a rectangular frame comprising an upper channel iron 38, an intermediate channel iron 39, a lower channel iron 40, side channel irons 42 and 43, and U-shaped channels 44 and 45 located inwardly of, and parallel to, channel irons 42 and 43. A wall 46 is inset from the door frame, the lower end thereof being provided with a rectangular opening 48 of substantial size through which ram 28 of packer unit 20 passes to force refuse into the container.

Figure 3:
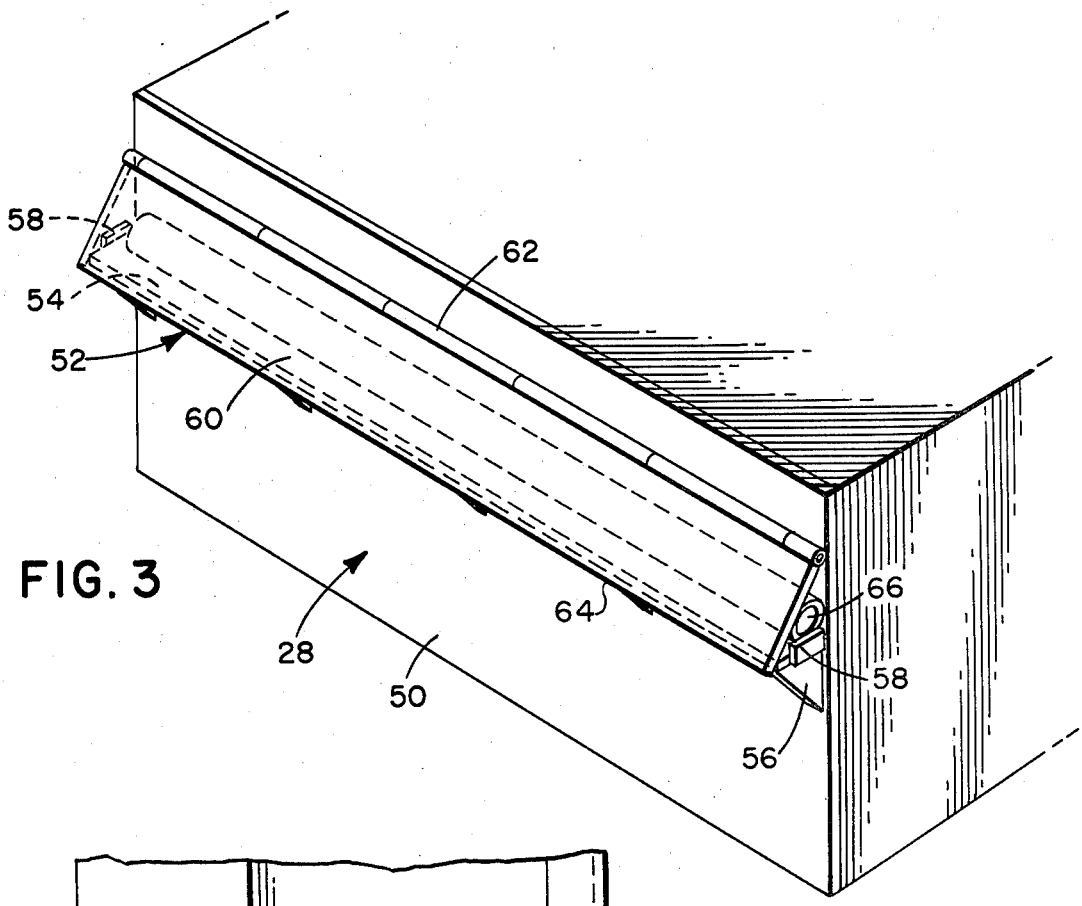
FIG. 3 is a perspective view of the face of a ram forming a part of the packer unit of the stationary compactor, and illustrating the application of the present invention.

Referring now to FIG. 3 of the drawing, ram 28 of packer unit 20 has a front, refuse-engaging face of rectangular configuration, on which is mounted a pin-off pipe storage compartment generally designated 52. Storage compartment 52 extends transversely of, and is co-extensive with, the upper portion of the face of the ram in parallel relation to the line of travel thereof. Storage compartment 52 includesa a ledge 54 secured to, and extending outwardly from, the face of the ram, which ram is substantially co-extensive with the width of the ram. Ledge 54 is supported by a series of spaced triangular-shaped brackets 56, and stops or abutments 58 extend upwardly from the ends of the ledge for purposes which will be hereinafter more fully set out.

Figure 2:
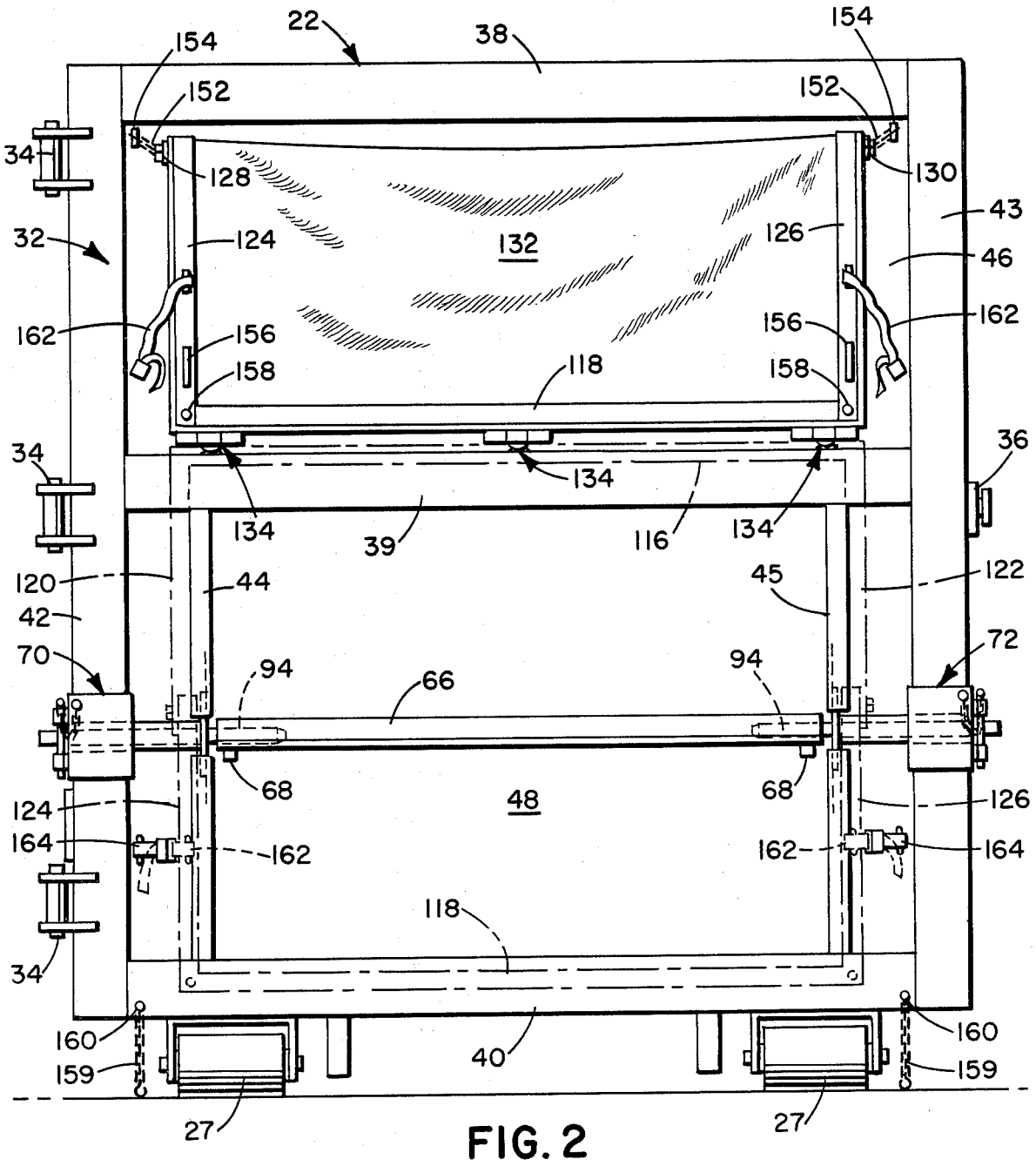
FIG. 2 is an end elevational view of the refuse container of a stationary compactor illustrating the assembly of the present invention.
Figure 7:
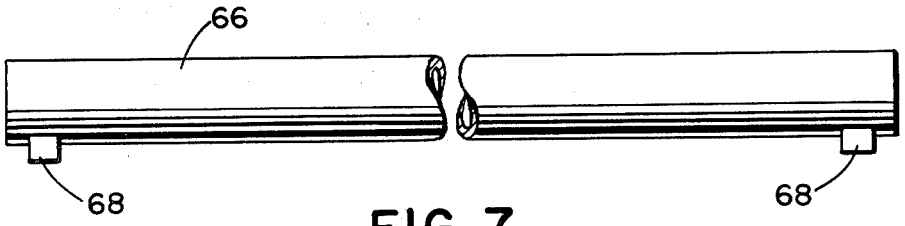
FIG. 7 is a side elevational view of the pin-off pipe forming a part of the present invention.
Figure 8:
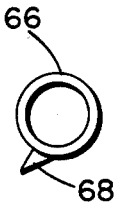
FIG. 8 is an end elevational view of the pin-off pipe of FIG. 7.

Compartment 52 further includes a front side comprising a flap 60 which is hingedly engaged at 62 to front face 50 at a point above ledge 54, the front flap extended forwardly at an incline, and with the lower edge 64 thereof engaging the forward edge of ledge 54, as shown in FIGS. 1 and 2. This forms a triangular shaped storage area between ram face 50, ledge 54 and front flap 60. A pin-off pipe 66 is placed within the storage area on ledge 54 and is adapted to remain there during the compacting operation. Since the storage area is enclosed, no refuse will accidentally enter the same. Stops 58 at the end of ledge 54 serve to positively preclude lateral movement of pin-off pipe 66 during operation of the ram. Forward motion of pin-off pipe 66 is prevented by flap 60, but, in order to positively preclude any rolling of the pin-off pipe, a pair of spaced projecting stops 68 of generally triangular cross-section extend outwardly from the pipe periphery for engagement with ledge 54, as shown to advantage in FIGS. 7 and 8.

The pin-off portion of the assembly further includes, in combination with pin-off pipe 66, a pair of spaced pin-off pipe support assemblies 70 and 72 located on opposed sides of door 32, which are shown to advantage in FIGS. 2, 4, 5 and 6. Each assembly 70 and 72 includes a pin support member which comprises a U-shaped channel member having sides 74 and 76 which are joined by an intermediate connecting member 78. A tubular sleeve 80 extends from side member 74 through and beyond side 76 to a plate 82 which is in spaced parallel relation to side 76.

Figure 4:
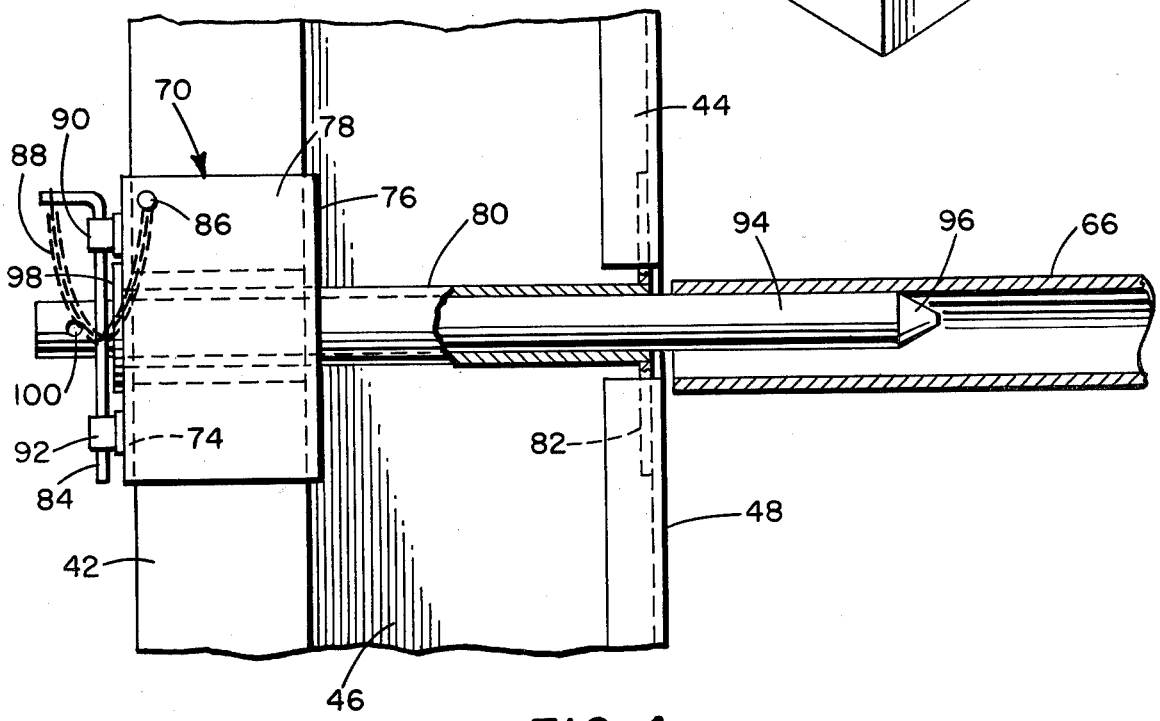
FIG. 4 is an enlarged, fragmentary elevational view, partly in section, illustrating the pin-off assembly of the present invention.
Figure 5:
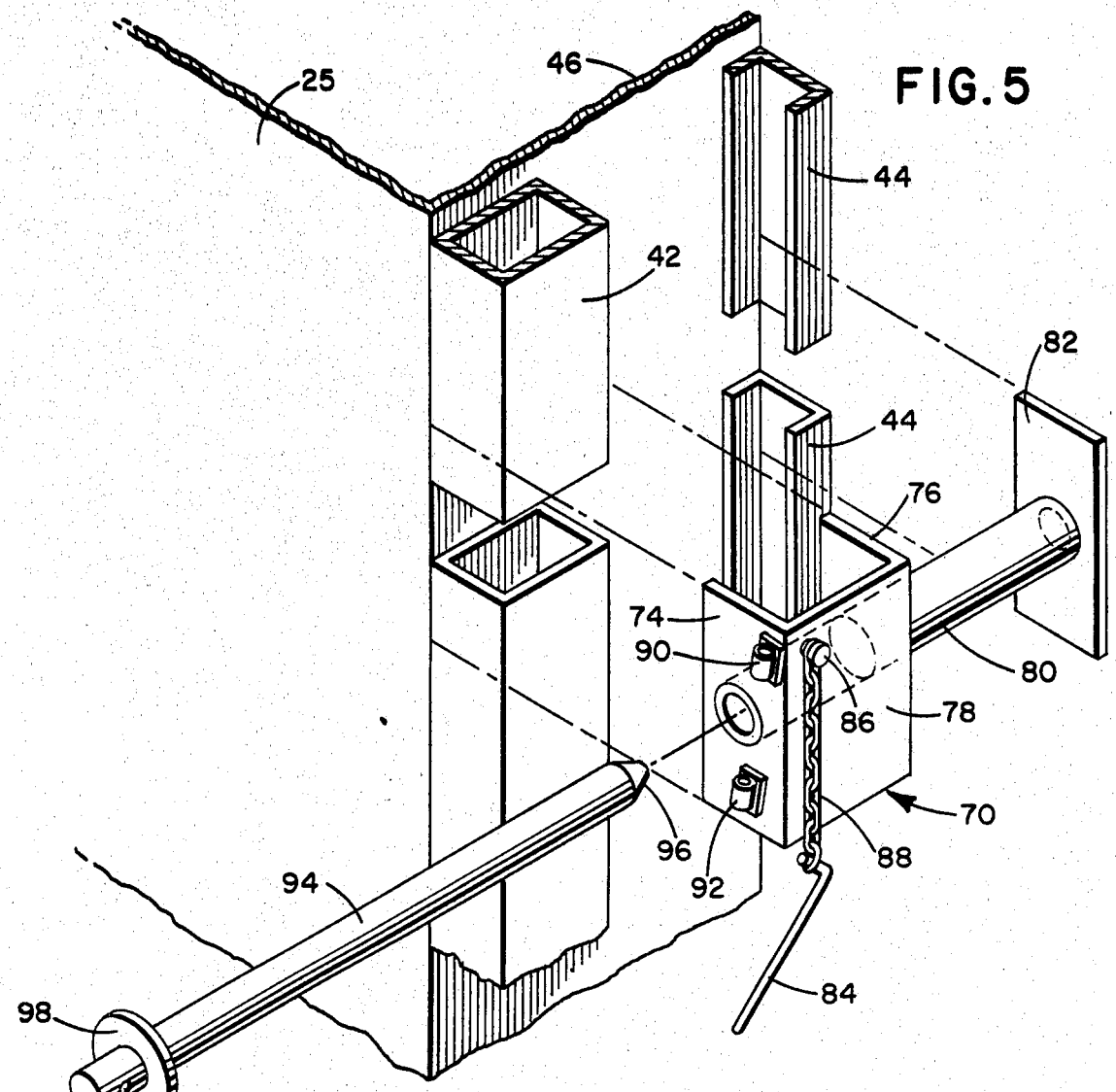
FIG. 5 is a fragmentary exploded perspective view of the pin-off assembly of the present invention with the associated handle for inserting and removing the pin forming a part thereof.
Figure 6:
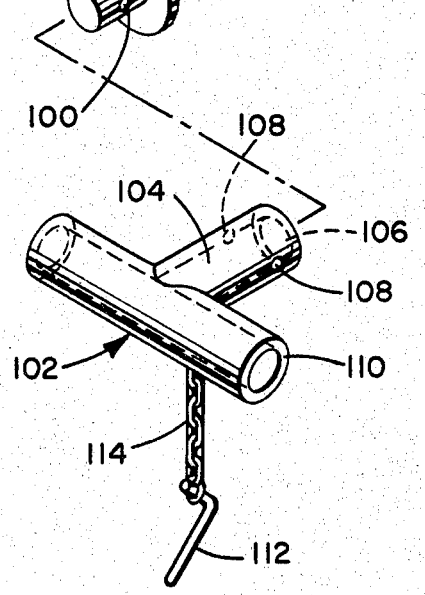
FIG. 6 is an end elevational view of the pin-off assembly in operative position.
Figure 6:
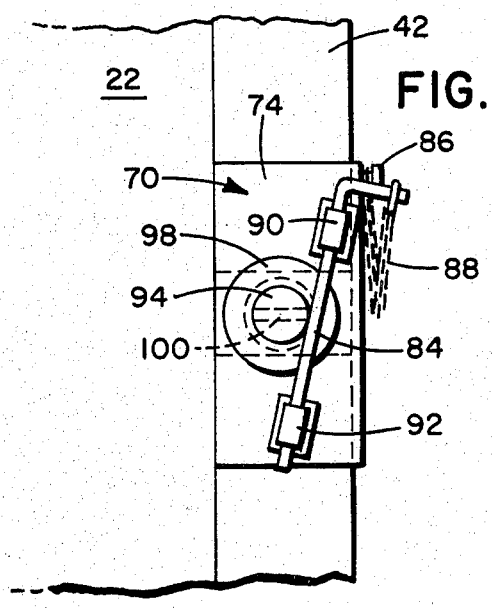

As shown to advantage in FIGS. 4 and 5, portions of side channel irons 42 and 43 and portions of U-shaped channels 44 and 45 are removed to permit the passage of tubular sleeve 80 through these members in order that the U-shaped channel members and plates of pin-off pipe support assembly 70 and 72 may be welded to these members.

The pin-off assembly further includes a retaining pin 84 which is secured to a post 86 by a flexible chain 88. In association with pin 84, there are provided a pair of spaced, tubular pin keepers 90 and 92 having aligned longitudinal bores, the purpose of which will be hereinafter set out.

Pin-off pipe support assemblies 70 and 72 each include a pipe-engaging pin or finger 94, one end of which is tapered at 96 to facilitate insertion thereof through sleeve 80 into supporting engagement with an end of pin-off pipe 66, as shown to advantage in FIGS. 2 and 4. A washer-like flange 98 extends outwardly from the periphery of each pin 94 for engaging side 74 of the U-shaped channel member to limit entry of pin 94 into sleeve 80 and into the end of pipe 66. A bore 100 extends diametrically through the end portion of pin 94 and, when the pin is fully inserted into the sleeve and the end of the pipe, pin 84 may be inserted through keeper 90 and keeper 92 in order to retain the pin in operative position by maintaining flange 98 in contiguous engagement with side 74 of the U-shaped channel member.

A handle 102 is provided for inserting and removing each pin 94, which handle is of generally T-shape construction and includes a tubular leg portion 104 having a longitudinally bore 106 adapted for insertion over the outer terminal of pin 94. Openings 108 are provided on diametrically opposed sides of the wall of leg portion 104, which openings are also aligned with bore 100 of pin 94. T-shape handle 102 further includes a hand-engaging portion 110 to which leg portion 104 is centrally connected and a connecting pin 112 which is tethered to a hand engaging portion 110 by a chain 114.

Handle 102 is engaged with pin 94 by inserting the outer end of pin 94 into bore 106 of leg portion 104 and inserting pin 112 through openings 108 and bore 100. This permits ready insertion and removal of pins 94, and prevents tampering by anyone other than an authorized person in possession of the handle.

The door closure portion of the present invention is shown to advantage in FIGS. 2 and 9 to 12.

Figures 9, 10, 12:
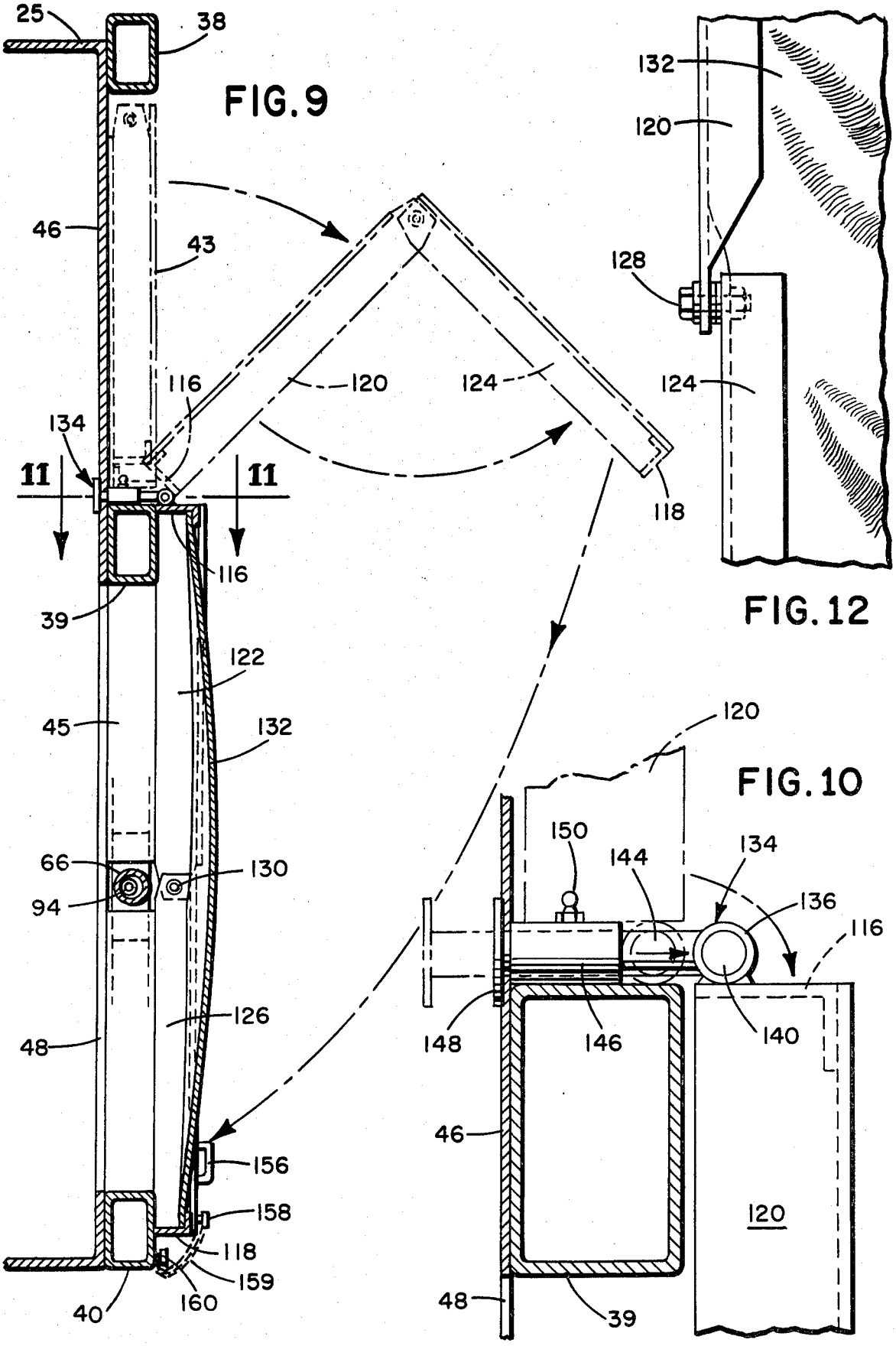
FIG. 9 is a vertical sectional view of the refuse container door of the stationary compactor, illustrating the door closure portion of the present assembly.
FIG. 10 is an enlarged, fragmentary side elevational view, partically in section, of the sliding hinge assembly forming a part of the door closure.
FIG. 12 is a fragmentary side elevational view of the door closure showing to advantage the hinged connection between the sections thereof.

The closure includes a rigid frame of substantially rectangular conformation including an upper horizontal member 116 and a lower horizontal member 118, both of angle iron construction. The sides of the frame each comprise upper arm portions 120, 122 and lower arm portions 124, 126 of substantially equal length. The upper and lower arm portions are pivotally connected at 128, 130, the arm portions being of angular construction, and permitting the closure to be folded in half by nesting the lower arm portions within the upper arm portions, as shown in FIG. 9. A cover 132 of flexible mesh material is secured within the frame of the closure, which cover is adapted to overlie opening 48 of container 22 when the door closure is moved to operative position. Upper horizontal member 116 is hingedly engaged with container 22 by means of a plurality of spaced hinge assemblies 134.

Each hinge assembly 134 includes spaced tubular members 136 and 138 which are fixedly secured to upper horizontal member 116. A rod is inserted into tubular member 136 and passed between and through tubular member 183, the rod being fixed to the tubular members. A third tubular member 142 is in sleeved engagement with that portion of rod 40 which extends between tubular members 136 and 138, tubular member 142 being rotatable on rod 140.

Each hinge assembly further includes a sliding tubular member 144, one end of which is fixed to the outer periphery of tubular member 142 and extends through a sleeve member 146 which is fixedly engaged with interior channel iron member 39. A stop member 148 is fixed to the opposite end of member 144 on the interior side of container wall 46, which stop comprises a peripheral flange which engages the wall to limit the sliding movement of tubular member 144 in a direction outwardly of the container. A grease fitting 150 permits a lubricant to be applied to the outer periphery of tubular member 144 to facilitate sliding movement of the latter within sleeve 146.

The door closure portion of the present assembly further includes chains 152 which are attached to the frame and adapted to engage hooks 154 for retaining the door closure in raised, folded position. Handles 156 are located near the lower end of arm portions 124 and 126 of the frame for facilitating raising and lowering of the closure. Additionally, posts 158 adjacent the lower bend of lower arm portions 124 and 126 are adapted to be engaged by chains 159 which are affixed to posts 160 on lower channel iron member 40 for retaining the door closure in operative positon over the door opening 48.

In order to draw the door closure tight against the refuse protruding through the door opening, there are provided adjustable cinch belts 162 which are mounted on lower arm portions 124 and 126 of the door closure frame. Belts 162 engage complemental members 164 which are secured to door 32 adjacent opening 48 to draw the closure tightly over the opening.

OPERATION

In use of the pin-off and door closure assembly of the present invention, packer unit 20 and refuse container 22 are joined together by attachment means 24, following which ram 28 is operated by a piston 30 within elongated housing 26 to force refuse from the housing into the container. This operation is repeated until the refuse is compacted within the refuse container and the container is full.

During this portion of the operation, pin-off pipe 66 is carried within storage compartment 52, and, by virtue of hinged flap 60 forming the front side of the storage compartment, no refuse is permitted to enter the storage compartment.

When it is desired to pin-off opening 48 of the refuse container, preparatory to transporting the same to a disposal site, ram 28 is advanced forwardly into container 22 until pin-off pipe 66 is aligned with pin-off support assemblies 70 and 72. Pins 94 are then inserted through sleeve 80 from each side of the storage container by means of handle 102, following which ram 28 is retracted, thereby permitting pipe 66 to urge flap 60 upwardly on hinge 62, and to enable the ram to be retracted and leave the pin-off pipe in position across the container opening.

Packer unit 20 is then disengaged from refuse container 22, thereby leaving opening 48 of the refuse container exposed. In view of the compressed state of the refuse in the container, it will bulge outwardly slightly through opening 48, the amount of bulging being limited by pin-off pipe 66.

It will be noted from a consideration of FIGS. 2 and 9 that the door closure is normally stored within the confines of the frame of the refuse container door. When it is desired to place the door closure over the door opening, chains 152 are unhooked, thereby enabling the closure to begin unhinging as illustrated in FIG. 9. The enclosure would ordinarily tend to fall straight down over the container door opening and strike material protruding through this opening, causing it to hang up or to knock refuse out of the opening onto the ground. However, the hinging arrangement of the present invention causes the bottom half of the door closure to swing down at the same time the top half swings out under the influence of sliding tubular member 144 forming a part of the hinge assembly. When the top half has reached a point slightly past perpendicular to the ground, it stops momentarily, thereby assuring that the bottom half is now hanging down but suspended away from the container opening. The weight of the unit causes the sliding portion of the hinge to extend outwardly and, as it is extending outwardly, the upper half slowly descends downwardly until the door closure is in the same plane as the door. To secure the door closure solidly against the door, cinch belts 162 are engaged with mating members 164 and drawn tight to secure the closure solidly against the door. Chains 159 are secured in place to complete the operation, following which the refuse container is ready for transportation to its disposal site.

After the refuse is removed from the container at the disposal site, by unlatching and opening door 32 the door closure is returned to its storage site by reversing the above procedure, thereby permitting the closure frame and flexible mesh cover to be folded on itself and stored above the door opening within the frame of the door.

Pin-off pipe 66 may then be removed from the door opening by engaging pins 94 with handle 102 and pulling the pins from the container. Pin-off pipe 66 may then be reinserted into storage compartment 52 on the face of the ram, after which the operational cycle is repeated.

The assembly of the present invention affords simple and efficient means for directly transferring a pin-off pipe from a storage compartment on the front face of the packer unit ram to its operative position across the opening of a refuse container door, and to cover the door opening with a closure which retains the compacted refuse within the container, thereby preventing any refuse from falling through the container opening during transport of the container to a disposal site.

Although there has been herein disclosed the presently preferred form of this invention, it is to be understood that such has been done for purposes of illustration only, and that various changes may be made therein within the scope of the appended claims.

What is claimed is:

1. In combination with a stationary refuse compactor assembly including a refuse container having a load opening, and a packer unit having a reciprocating ram detachably engaged with said container for forcing refuse through the load opening into the refuse container, a door closure assembly for positioning across the load opening of the refuse container, said door closure assembly including (a) a frame of rigid material (b) a cover of flexible material within said frame, and (c) hinge means connecting the top of said frame to the portion of the container above the container opening whereby the door closure may be swung upwardly to a position of storage when not in use (d) said hinge means includes means for urging said frame and cover outwardly from the container and downwardly to a position of use over the container opening.

2. The door assembly of claim 1, wherein (a) said hinge means includes a plurality of hinge assemblies connecting said frame to said container (b) each of said hinge assemblies including a pair of spaced tubular members fixed to said frame (c) a rod extending through and between said pair of spaced tubular members (d) a third tubular member rotatably mounted on said rod between said pair of tubular members (e) means secured to said third tubular member and extending in the direction of said refuse container (f) a fourth tubular member mounted on said container and in sleeved relation with said means, whereby said door closure may be moved outwardly away from said container to permit the door closure to cover refuse protruding through the load opening.

3. The door closure assembly of claim 2, with the addition of (a) stop means for limiting the outward movement of said door closure with respect to the refuse container.

4. The door closure assembly of claim 3, wherein (a) said means forming a part of the hinge comprises a fifth tubular member which means extends through an opening in said container, and (b) said stop means include a peripheral flange extending outwardly from an end of said fifth tubular member of said rod and engageable with the container adjacent the opening.

5. The door closure assembly of claim 1, wherein (a) said frame is of rectangular shape and includes top, bottom and side members (b) each of said side members comprising two sections of approximately the same length, and (c) means for pivotally connecting said section of each of said side members in order to permit folding of said door closure when it is raised to a position of storage over the door opening.

6. The door closure of claim 5, wherein (a) said top, bottom and side members of the frame are of angular construction to allow the lower portion of the frame to nest within the upper portion of the frame when the door closure is in the stored position.

7. The door closure of claim 1, with the addition of (a) a pin-off pipe and (b) means engaged with said refuse container for detachably positioning said pin-off pipe across the opening of the refuse container, whereby said pin-off and door closure coact to prevent compressed refuse within the refuse container from falling through the load opening during transport of the refuse container to a disposal site.

8. In combination with a stationary refuse compactor assembly including a refuse container having a load opening, and a packer unit having a reciprocating ram detachably engaged with said container for forcing refuse through the load opening into the refuse container, a pin-off assembly for positioning across the load opening of the refuse container, said pin-off assembly including (a) an elongated member adapted to be positioned across the load opening, the ends of said elongated member being provided with pin-receiving recesses (b) said refuse container being provided with opposed openings adjacent the load opening (c) pin support means carried by said container and aligned with the opposed openings adjacent the load opening (d) retaining pins positioned in said pin support means and inserted through the opposed openings of the refuse container into the pin-receiving recesses in said elongated member (e) said retaining pins being removable to withdraw said elongated member from the load opening, and (f) stop means for limiting the extent of entry of each of said retaining pins into the pin-receiving recesses of said elongated member.

9. The pin-off assembly of claim 8, wherein (a) said elongated member comprises a pipe which is substantially coextensive with the width of said container opening.

10. The pin-off assembly of claim 8, wherein (a) said pin support means comprises tubular sleeves through which said retaining pins are inserted, and (b) means for securing said tubular sleeves to said refuse container.

11. The pin-off assembly of claim 8, wherein (a) said stop means includes a flange extending outwardly from the periphery of each of said retaining pins (b) said flange engaging the container adjacent the opposed openings.

12. The pin-off assembly of claim 11, with the addition of (a) means carried by said container engageable with said flange for preventing accidental disengagement of said pins with respect to said elongated member.

13. The pin-off assembly of claim 12, wherein (a) said means carried by said container comprise pins, each of which is positioned across said flange to prevent movement of said retaining pins relative to the container, and (b) means fixed to said container and engageable with the ends of said pins for positively preventing movement of said pins.

14. The pin-off assembly of claim 13, wherein (a) said means fixed to said container comprise spaced tubular pin keepers through which said pins are inserted.

15. The pin-off assembly of claim 8, with the addition of (a) storage means for said elongated member carried by said reciprocating ram during the loading of the refuse container.

16. The pin-off assembly of claim 15, wherein (a) said storage means include a ledge extending outwardly from the front face of the ram on which the elongated member rests, and (b) a front flap hingedly engaged with the front face of said ram, and extending forwardly at an incline, the lower end of said flap engaging the forward end of the flap, thereby forming a refuse-free storage compartment for the elongated member, whereby upon extension of said ram into the container, said retaining pins are engaged with said elongated member, following which said ram is withdrawn from the container, thereby causing the hinged flap to lift as the storage compartment is removed from engagement with the elongated member.

17. The pin-off assembly of claim 16, with the addition of (a) abutments engaged with the ends of said ledge for preventing accidental lateral movement of said elongated member.

18. The pin-off assembly of claim 16, with the addition of (a) at least one stop member projecting outwardly from the outer periphery of said elongated member for preventing rolling movement of said pipe while on said ledge.

19. The pin-off assembly of claim 8, with the addition of (a) a door closure stored above the load opening, and (b) means for moving said door closure into covering relation to the load opening.

20. The pin-off assembly of claim 19, wherein (a) said door closure includes a frame (b) a cover of flexible material within said frame (c) hinge means for connecting said door closure to said container (d) a first means for securing said door closure in its stored position, and (e) a second means for securing said door closure over the load opening, whereby said door closure and elongated member coact to prevent compressed refuse within the refuse container from falling through the load opening during transport of the refuse container to a disposal site.

* * * * *